United States Patent [19]

Eckel et al.

[11] Patent Number: 4,877,673

[45] Date of Patent: Oct. 31, 1989

[54] EDGE PROTECTOR

[75] Inventors: Hans-Joachim Eckel, Wesel; Hans Warych, Gelsenkirchen, both of Fed. Rep. of Germany

[73] Assignee: Signode System GmbH, Dinslaken, Fed. Rep. of Germany

[21] Appl. No.: 206,235

[22] Filed: Jun. 13, 1988

[30] Foreign Application Priority Data

Jun. 13, 1987 [DE] Fed. Rep. of Germany ..... 3719847

[51] Int. Cl.[4] ..... B32B 3/06

[52] U.S. Cl. ..... 428/172; 428/194; 428/343; 248/345.1; 52/716; 206/453; 206/586; 206/813

[58] Field of Search ..... 428/121, 172, 194, 343; 248/345.1; 206/813, 586, 453; 52/716

[56] References Cited

U.S. PATENT DOCUMENTS 4,741,126 5/1988 Adell ..... 52/716

*Primary Examiner*—Alexander S. Thomas

*Attorney, Agent, or Firm*—Herbert Dubno

[57] ABSTRACT

An L-shaped extruded edge-protector section for the strapping of articles, stacks or the like, has along the inner or outer surfaces of the respective flanges, respective adhesive strips while the opposite surfaces having longitudinal recesses so that when the edge-protectors are stacked, the adhesive strips are received with clearance in the recesses of adjacent edge-protectors. The edge-protectors when stacked thus do not adhere to one another even though masking strips are not provided for the adhesive strips.

4 Claims, 2 Drawing Sheets

EDGE PROTECTOR

FIELD OF THE INVENTION

Our present invention relates to an edge protector for use in the protection of the edges of an article adapted to be encircled by a strap and, more particularly, to an edge protector of generally L-shaped cross section which is elongated and is provided with at least one pressure-adhering adhesive strip.

BACKGROUND OF THE INVENTION

Strapping systems are widely used for packaging articles, retaining articles on shipping pallets, and like storage and transport systems. The articles which may be strapped can include furniture articles which may be wrapped in whole or in part and provided with edge protectors to prevent deterioration of the edges by the straps or in handling.

They may also be stacks of articles, such as packages, which can be strapped to hold them together and in which case the edge protectors are principally designed to prevent deterioration of or damage to the articles at edges of the stack.

Whatever may be the kind of article used or the purpose, the edge protector is interposed between the strap and the article and the strap is under tension against the edge protector.

In the past, paper laminates, bent about an axis midway of the width of the laminate between the longitudinal edges thereof, have been used as edge protectors and have a generally L-shaped profile or cross section with a pair of angularly adjoining flanges. Because of the bending action, however, such edge protectors are not always satisfactory since the junction region between the flanges may be excessively rounded, i.e. flat inner surfaces of the flanges at right angles to one another do not approach one another sufficiently closely.

Furthermore, when such edge protectors are applied, for example, to furniture or like hard articles with sharp edges, the edge protector may not form a sufficient cushion for the sharp edge of the article, or the desired level of tension of the strap may not be obtainable, or this tension may not be maintained over long periods of time.

It has been recognized that it is advantageous to provide the edge protector with a pressure-adhering adhesive strip to hold the edge protector in place on the article or with respect to the strap which is designed to encircle the article during the strapping process.

Generally, the edge protectors are supplied or stored in stacks and when the edge protector is provided with an adhesive strip, the removal of an edge protector from the stack thereof for application to the article may be troublesome or difficult because of the adhesion of the adhesive strip of one edge-protector body to the adjoining edge-protector body. Also, when the adhesive strip has contacted another edge-protector body, it is found to have a reduced adhesion force with respect to the article or strap.

To prevent this phenomenon and to simplify the separation of the stacked edge-protector bodies, it has been proposed to wrap at least the regions of the edge protectors which might come into contact with adhesive strips of other edge protectors with a silicone-coated paper or to apply silicone-coated masking strips between the adhesive strips and the bodies which may be contacted thereby. This is of course expensive and requires handling of additional material.

OBJECT OF THE INVENTION

It is, therefore, the principal object of the present invention to provide an improved edge protector for the purposes described which is free from the drawbacks outlined above and especially can be used effectively to protect sharp-edged hard articles and can be provided in stacks without causing manipulation problems or requiring involved handling.

SUMMARY OF THE INVENTION

These objects and others which will become apparent hereinafter are attained, in accordance with the invention with an edge protector which has a body of L-shaped cross section or profile at least partly extruded from a thermoplastic synthetic resin mass and between longitudinal edges of which a longitudinally extending inward concavity or recess is formed on one side and so positioned with respect to a self-adhesive strip on the other side of the body that, when the edge protector is stacked with other identical edge-protectors, the recesses preclude direct contact of surfaces of the bodies with the adhesive strips of other bodies.

The recesses can be provided on the outer surfaces of the flanges and the self adhesive strips on the inner surfaces of the flanges or, conversely, the adhesive strip may be provided on the outer surfaces of the flanges while the recesses are provided along the inner surfaces thereof.

The edge protector of the invention thus comprises:

an elongated body of a generally L-shaped cross section composed at least in part of extruded thermoplastic synthetic resin and having a pair of flanges angularly adjoining at a junction and formed with respective longitudinal edges, the body having inner and outer surfaces; and a pressure-adhering strip on one of the surfaces between the longitudinal edges and extending generally along a longitudinal dimension of the body, the body being formed in the other of the surfaces with a longitudinally extending recess located with respect to the strip such that, upon stacking of the edge-protector with other identical edge protectors, an adhesive strip of one of the stacked edge protectors will lie in a recess of another of the stacked edge protectors without contact with the respective body thereof.

With the edge protector of the invention, it is no longer necessary to provide a wrapping of silicone-coated paper or intervening or masking layers of such paper in the stack of edge protectors, especially when the edge protectors have their recesses on the outer surfaces since protection of the adhesive strips of the last member of the stack is not necessary.

Indeed, utilizing conventional paper laminate technology for fabricating edge protectors, it is not possible to provide such recesses in a practical manner. According to the invention, the edge protector can be fabricated by extrusion and the adhesive strips can be formed during the extrusion processes on the profile body by coextrusion.

The edge-protector lengths can be then severed from the continuous strand produced by coextrusion. Any conventional extrudable thermoplastic synthetic resin can be used, although scrap polyethylene has been found to be a more suitable material and we can even extrude the edge-protector body from a paper/thermoplastic synthetic resin mixture.

The longitudinal recesses on the outer surface have the further advantage that the contact surface for the enveloping strap is significantly reduced and the tendency toward slackening of the strap is correspondingly reduced.

Preferably at the junction of the two flanges, between the planar inner surfaces thereof, i.e. at the angle included between these surfaces and thus at the central inner longitudinal edge a channel or groove-like recess is provided along the length of this edge. This permits a deformation of the body against the article to ensure that the flanges will lie properly against the latter, eliminates possible contact with a sharp edge of the article which may be detrimental to it, and guarantees that the edge protectors will lie properly in one another upon being stacked so that the adhesive strips will always be positioned within the longitudinal recesses of adjoining edge protectors. The sharp edge of the article can project into the groove without contact with the edge-protector body. Another advantage, of course, is that this shape allows the edge-protector body to be easily fabricated by extrusion.

BRIEF DESCRIPTION OF THE DRAWING

The above and other objects, features and advantage of my invention will become more readily apparent from the following description, reference being made to the accompanying highly diagrammatic drawing in which.

SPECIFIC DESCRIPTION

Figure 1:
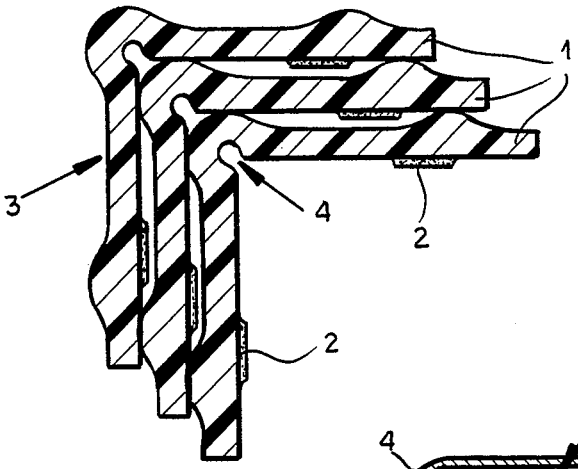
FIG. 1 is a cross sectional view through a stack of edge-protector sections in accordance with the invention.

As will be apparent from the drawing, an edge protector 1 or 101 can be used on an article W which may be an article of furniture, a stack of discrete objects on a pallet, a stack of boxes, packets or the like, represented at W to protect against damage to the article or objects by a strap or band B applied under tension therearound.

Figure 2:
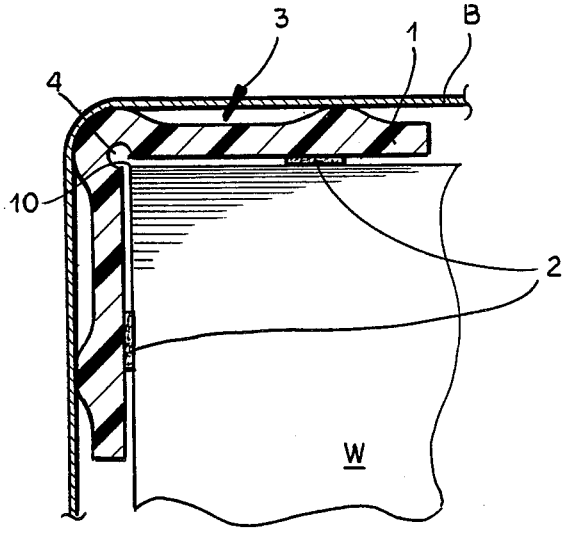
FIG. 2 is a cross sectional view illustrating the application of an edge protector as shown in FIG. 1 to a stack of articles or to a single article around which a strap is applied.
Figure 4:
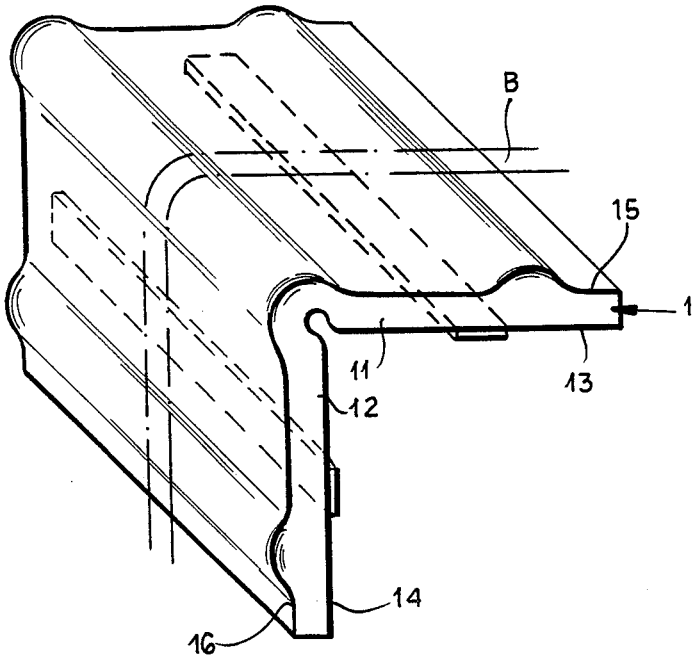
FIG. 4 is a perspective view of one of the edge protectors seen in FIGS. 1 and 2.

The edge protector of FIGS. 1, 2 and 4 comprises a pair of flanges 11 and 12, each having an inner surface 13 and 14 and an outer surface 15, 16.

Along the inner surfaces of these flanges, a self-adhesive longitudinal strap 2 can be applied, e.g. by coextrusion with the continuous thermoplastic strand from which the length of edge protector (see FIG. 4) is cut. The adhesive strip is a pressure-adherent adhesive which can be adhered without soiling or permanent bonding to an article of furniture or the like to hold the edge protector in place for the strapping operation.

The edge protector is an extruded mass which consists at least partially of thermoplastic synthetic resin, especially polyethylene. We have found that an extrudable mass for this purpose can be formed by the worm or extruder plastification of a mass of comminuted scrap consisting of paper and the thermoplastic synthetic resin in the form of plastic coated paper. In that case, the thermoplastic is contributed by the coating of the paper.

Between the longitudinal edges of the outer surfaces 15 and 16 of the flanges, a continuous longitudinal cavity or recess 3 is formed which is so located with respect to the respective adhesive strip 2, that when the edge profiles are stacked (FIG. 1), the adhesive strips project into the recesses 3 of adjacent edge profiles with clearance and thus do not come into contact with the bodies of these adjoining edge profiles.

It can be seen from FIG. 2 that the edge profile can have, along its central inner longitudinal edge, a channel-shaped longitudinal groove 4 which prevents contact with the sharp edge 10 of the article and thus damage to the latter even upon tensioning of the strap B.

Figure 3:
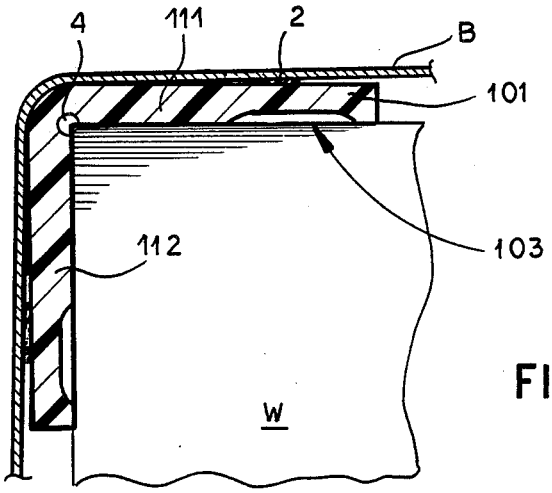
FIG. 3 is a view similar to FIG. 2 but illustrating a second embodiment.

The embodiment of FIG. 3 differs from that of FIGS. 1, 2 and 4 in that the recesses 103 in the flanges 111 and 112 are located along the inner surfaces of these flanges while the adhesive strips 2 are provided on the external surfaces of the flanges, for example, to fix the edge protector in place with respect to the strap B or vice versa.

We claim:

1. An edge protector adapted to be interposed between a strap and an article having an edge to be protected, said edge protector comprising:

an elongated body of a generally L-shaped cross section composed at least in part of extruded thermoplastic synthetic resin and having a pair of flanges angularly adjoining at a junction and formed with respective longitudinal edges, said body having inner and outer surfaces; and a pressure-adhering adhesive strip on one of said surfaces between said longitudinal edges and extending generally along a longitudinal dimension of said body, said body being formed in the other of said surfaces with a longitudinally extending recess located with respect to said strip such that, upon stacking of the edge protector with other identical, edge protector a said adhesive strip of one of the stacked edge protectors will lie in a said recess of another of the stacked edge protectors without contact with the respective body thereof, the recess being formed in the inner surface of the respective body and the respective adhesive strip being provided on the outer surface of the respective body.

2. The edge-protector defined in claim 1 wherein said body is formed along said junction between inner surfaces of said flanges with a longitudinal groove.

3. An edge protector adapted to be interposed between a strap and an article having an edge to be protected, said edge protector comprising:

an elongated body of a generally L-shaped cross section composed at least in part of extruded thermoplastic synthetic resin and having a pair of flanges angularly adjoining at a junction and formed with respective longitudinal edges, said body having inner and outer surfaces; and a pressure-adhering adhesive strip on one of said surfaces between said longitudinal edges and extending generally along a longitudinal dimension of said body, said body being formed in the other of said surfaces with a longitudinally extending recess located with respect to said strip such that, upon stacking of the edge protector with other identical, edge protector a said adhesive strip of one of the stacked edge protector a said adhesive strip of one of the stacked edge protectors will lie in a said recess of another of the stacked edge protectors without contact with the respective body thereof, each of said flanges having an inner and outer surface, a respective adhesive strip being applied to the inner surface of each flange of the respective body while the outer surface of each flange has a respective recess located with respect to the adhesive strip of the respective flange so that said adhesive strips of both flanges of a respective stacked edge protector lie in the two recesses of the other stacked edge protector without contact with the respective body thereof.

4. An edge protector adapted to be interposed between a strap and an article having an edge to be protected, said edge protector comprising:

an elongated body of a generally L-shaped cross section composed at least in part of extruded thermoplastic synthetic resin and having a pair of flanges angularly adjoining at a junction and formed with respective longitudinal edges, said body having inner and outer surfaces; and a pressure-adhering adhesive strip on one of said surfaces between said longitudinal edges and extending generally along a longitudinal dimension of said body, said body being formed in the other of said surfaces with a longitudinally extending recess located with respect to said strip such that, upon stacking of the edge protector with other identical, edge protector a said adhesive strip of one of the stacked edge protectors will lie in a said recess of another of the stacked edge protectors without contact with the respective body thereof, each of said flanges having an inner and outer surface, a respective adhesive strip being applied to the outer surface of each flange of the respective body while the inner surface of each flange has a respective recess located with respect to the adhesive strip of the respective flange so that said adhesive strips of both flanges of a respective stacked edge protector lie in the two recesses of the other stacked edge protector without contact with the respective body thereof.

* * * * *